US011340027B2

(12) United States Patent
Reinhardt et al.

(10) Patent No.: US 11,340,027 B2
(45) Date of Patent: May 24, 2022

(54) TUBE FOR A HEAT EXCHANGER, AND METHOD OF MAKING THE SAME

(71) Applicant: Modine Manufacturing Company, Racine, WI (US)

(72) Inventors: Roman C. Reinhardt, Neckartenzlingen (DE); Andreas F. Stolz, Walddorfhäslach (DE); Marius Dornseif, Aichtal (DE)

(73) Assignee: MODINE MANUFACTURING COMPANY, Racine, WI (US)

( * ) Notice: Subject to any disclaimer, the term of this patent is extended or adjusted under 35 U.S.C. 154(b) by 0 days.

(21) Appl. No.: 16/927,115

(22) Filed: Jul. 13, 2020

(65) Prior Publication Data

US 2021/0018276 A1 Jan. 21, 2021

Related U.S. Application Data

(60) Provisional application No. 62/874,003, filed on Jul. 15, 2019.

(51) Int. Cl.

| | |
|---|---|
| ***F28F 1/00*** | (2006.01) |
| ***F28F 1/12*** | (2006.01) |
| ***F28F 3/02*** | (2006.01) |

(52) U.S. Cl.

CPC ..... *F28F 1/128* (2013.01); *F28F 3/027* (2013.01); *F28F 1/003* (2013.01)

(58) Field of Classification Search

CPC ..... F28F 1/128; F28F 3/027; F28F 1/003
USPC ..... 165/177
See application file for complete search history.

(56) References Cited

U.S. PATENT DOCUMENTS

| | | | | |
|---|---|---|---|---|
| 4,805,693 | A * | 2/1989 | Flessate | F28F 3/025 165/DIG. 464 |
| 5,636,685 | A * | 6/1997 | Gawve | F28D 1/0316 165/166 |
| 7,992,628 | B2 * | 8/2011 | Melby | F28D 9/0068 165/41 |

(Continued)

FOREIGN PATENT DOCUMENTS

| | | |
|---|---|---|
| DE | 102013216976 A1 | 3/2015 |
| EP | 1 548 385 A2 | 6/2005 |

(Continued)

OTHER PUBLICATIONS

Extended Search Report issued from the European Patent Office for related Application No. 20000255.8 dated Nov. 3, 2020 (6 Pages).

*Primary Examiner* — Claire E Rojohn, III
(74) *Attorney, Agent, or Firm* — Michael Best & Friedrich LLP

(57) ABSTRACT

A tube for a heat exchanger includes a tube outer body enclosing a tube inner volume, and a corrugated insert received within the tube inner volume. The tube outer body has a pair of broad planar walls joined by arcuate end walls. The corrugated insert defines flow channels through the tube, with opening in flanks of the insert allowing for flow communication between adjacent flow channels. Bypass channels adjacent the arcuate end walls are fluidly isolated from the adjacent flow channels by the absence of such openings in the end flanks. Flow through the bypass channels is obstructed by flow blocks at one or both ends of the bypass channels.

12 Claims, 5 Drawing Sheets

(56) References Cited

U.S. PATENT DOCUMENTS 8,397,795 B2 * 3/2013 Seto ..... F28D 1/05366 165/41
8,844,504 B2 9/2014 Raduenz et al.
9,664,144 B2 * 5/2017 Vallee ..... F02M 35/1036
10,711,743 B2 * 7/2020 Vallee ..... F02M 35/10
2002/0074109 A1 * 6/2002 Rhodes ..... F28D 1/05366 165/109.1
2005/0016240 A1 * 1/2005 Zurawel ..... F28F 3/027 72/177
2006/0032613 A1 * 2/2006 Brost ..... F02M 26/57 165/103
2006/0096747 A1 * 5/2006 Brost ..... F28D 9/0037 165/166
2006/0201663 A1 * 9/2006 Strahle ..... F28D 9/0031 165/157
2006/0243429 A1 * 11/2006 Chu ..... F28F 3/025 165/177
2007/0051502 A1 * 3/2007 Yamauchi ..... F28F 1/128 29/890.047
2008/0230213 A1 * 9/2008 Roll ..... B21D 53/08 165/173
2011/0226222 A1 9/2011 Raduenz et al.
2012/0247600 A1 * 10/2012 McNulty ..... F28F 1/022 72/46
2013/0074814 A1 * 3/2013 Schatz ..... F28F 9/0265 123/568.12
2014/0318170 A1 * 10/2014 Katoh ..... F25B 30/02 62/324.5
2015/0047818 A1 * 2/2015 Peskos ..... F28D 9/0037 165/166
2018/0128555 A1 * 5/2018 Kinder ..... F28D 9/0006
2018/0200779 A1 * 7/2018 Prokop ..... B21D 53/02
2019/0017748 A1 * 1/2019 Sun ..... F28F 3/027

FOREIGN PATENT DOCUMENTS

EP 1 548 385 A3 6/2012
WO 2006/116857 A1 11/2006
WO 2014/052309 A1 4/2014

* cited by examiner

TUBE FOR A HEAT EXCHANGER, AND METHOD OF MAKING THE SAME

CROSS-REFERENCE TO RELATED APPLICATION

This patent application claims priority to U.S. Provisional Application No. 62/874,003, filed Jul. 15, 2019, the entire contents of which are hereby incorporated by reference.

TECHNICAL FIELD

The present application relates to heat exchangers.

BACKGROUND

Tubes are used in heat exchangers to convey a fluid through the heat exchanger, and to transfer heat to or from the fluid through one or more walls of the tubes. In order to provide a compact and efficient design, the tubes often have a flattened shape that allows for the placement of extended surface features directly onto the outwardly facing flat surfaces of the tube. This type of design can lead to undesirable flow bypass channels at the ends of the tubes, wherein heat transfer to or from the fluid is less efficient.

SUMMARY

A tube for a heat exchanger includes a tube outer body having first and second broad, opposing, spaced apart, planar walls joined by first and second arcuate end walls. The tube outer body encloses a tube inner volume, and a corrugated insert is received within the tube inner volume. The tube inner volume is bounded by the first and second broad, planar walls and by the first and second arcuate end walls, and extends from an inlet end of the tube to the an outlet end of the tube. The corrugated insert has a series of planar flanks that joined together by alternating crests and troughs. The crests are joined to the first one of the broad planar walls, and the crests are joined to the second one of the broad planar walls.

Flow channels are provided within the tube, and extend through the tube inner volume from the inlet end of the tube to the outlet end of the tube. Each one of the flow channels is bounded by one of the broad planar walls of the tube outer body, by two adjacent ones of the planar flanks, and by the crest or trough that joins those two adjacent ones of the planar flanks.

A first and a second bypass channel are also provided within the tube. The first and second bypass channels can include all of the tube inner volume that is not occupied by either the corrugated insert or the flow channels. The first bypass channel can be bounded by one of the arcuate end walls (e.g. the first arcuate end wall) and the second bypass channel can be bounded by the other one of the arcuate end walls (e.g. the second arcuate end wall). The first and second bypass channels can each additionally be bounded by an end one of the planar flanks of the corrugated insert, particularly by the planar flank that is arranged nearest to the arcuate end wall that also bounds the bypass channel. Each of the first and second bypass channels can also be bounded by at least one, and in some cases both, of the broad planar walls. The first and second bypass channels can, in some cases, be bounded by two different ones of the broad planar walls, e.g. the first bypass channel can be bounded by the first broad planar wall and the second bypass channel can be bounded by the second broad planar wall, or vice versa. The first bypass channel and the second bypass channel can alternatively be bounded by the same one of the two broad, planar walls.

Adjacent ones of the flow channels can be placed in fluid communication with one another, between the inlet end and the outlet end of the tube, by way of openings that are arranged in the planar flanks. The openings in the planar flanks can be formed without the removal of material from the flanks, such as by louvered openings or by lanced and offset openings. This fluid communication between the flow channels can allow for enhanced heat transfer to or from a fluid traveling through the tube, as it serves to turbulate the flow of the fluid and prevent the formation of a fluid boundary layer, thereby enhancing the overall heat transfer coefficient within the tube.

The first and second ones of the planar flanks can be provided without any openings. This has the benefit of preventing the flow of fluid to or from the bypass channels from or to those flow channels that are arranged adjacent to the bypass channels. This further improves the heat transfer performance of the tube, since the bypass channels are less effective in transferring heat to or from the fluid traveling therethrough.

The overall transfer of heat to or from the fluid traveling through the tube can be further improved by preventing the flow of fluid through one or both of the bypass channels. This can be accomplished through the provision of a flow block at one or both ends of the tube. Such a heat transfer performance can be achieved by either fully preventing or mostly preventing fluid flow through the bypass channel. In other words, preventing fluid flow is not intended to mean a complete absence of any fluid flow.

The flow block can be arranged outside of the tube but immediately adjacent to the tube. In some cases the flow block can be provided by a tank that is in fluid communication with the tube, or by a plate that is arranged at the end of the tube.

The flow block can also or alternatively be arranged within the tube. In some cases the flow block can be formed using that end one of the planar flanks of the corrugated insert that bounds the bypass channel. For example, the flow block can be formed by deflecting a terminal portion of the end one of the planar flanks against the arcuate end wall that bounds the bypass channel, so that the bypass channel is entirely or mostly closed off at that end of the tube. Such a flow block can be made even more effective by brazing that terminal portion of the end planar flank to the arcuate end wall.

The tube can have more than one flow block. For example, the tube can have one flow block for the first bypass channel and another flow block for the second bypass channel. The tube can have flow blocks for each of the bypass channels arranged at the same end of the tube. For example, a flow block for the first bypass channel and a flow block for the second bypass channel can both be arranged at the inlet end of the tube, or can both be arranged at the outlet end of the tube. The tube can alternatively have flow blocks for each of the bypass channels arranged at opposing ends of tube. For example, a flow block for one of the bypass channels can be arranged at the inlet end of the tube and a flow block for the other bypass channel can be arranged at the outlet end of the tube. It is also possible for one or both of the bypass channels to have flow blocks arranged at both the inlet end and the outlet end of the tube.

The flow blocks for each of the two bypass channels can be the same type of flow block. For example, a first flow block for the first bypass channel and a second flow block for the second bypass channel can both be arranged external to the tube itself, such as by a wall extending from a tank or by a plate. As another example, a first flow block for the first bypass channel and a second flow block for the second bypass channel can both be arranged within the tube itself. The first flow block can be formed by deflecting a terminal portion of that end one of the planar flanks closest to the first arcuate wall of the tube against the first arcuate wall, and the second flow block can be formed by deflecting a terminal portion of that end one of the planar flanks closes to the second arcuate wall of the tube against the second arcuate wall. The flow blocks for each of the two bypass channels can also be of different types, however.

A method of making a tube for a heat exchange includes forming a corrugated insert having planar flanks joined by alternating crests and troughs, and inserting that corrugated insert into a flattened tube that has first and second broad, opposing, spaced apart, planar walls joined by first and second arcuate end walls. The method can also include deforming a terminal portion of at least one of the planar flanks adjacent to one of the first and second arcuate end walls to be in contact with that one of the first and second arcuate end walls.

The method can include the step of forming joints between at least some of the crests and troughs and the broad, opposing, spaced apart, planar walls. The method can also or alternatively include the step of forming joints between the terminal portion of a flank and that one of the first and second arcuate end walls with which it is in contact. In at least some cases the forming of the crest and trough joints and the forming of the terminal portion joint can be accomplished in the same step. The joints can be formed by brazing, or by other known methods of joining metal materials.

The step of forming a corrugated insert can include forming sets of louvers into a continuous ribbon of material at select intervals along a length direction of the continuous ribbon by piercing and displacing the material, followed by closing selected ones of the sets of louvers by re-displacing the material. The step can further include folding the continuous ribbon to form corrugations such that the crests and troughs are arranged between adjacent sets of louvers, and then separating the corrugated inserts from the continuous ribbon at a location adjacent to one of the closed sets of louvers. In at least some cases, the selected ones of the sets of louvers that are closed can include two adjacent sets of the louvers. In at least some such cases the corrugated inserts is separated from the continuous ribbon at a location between those two adjacent sets of louvers.

DETAILED DESCRIPTION

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
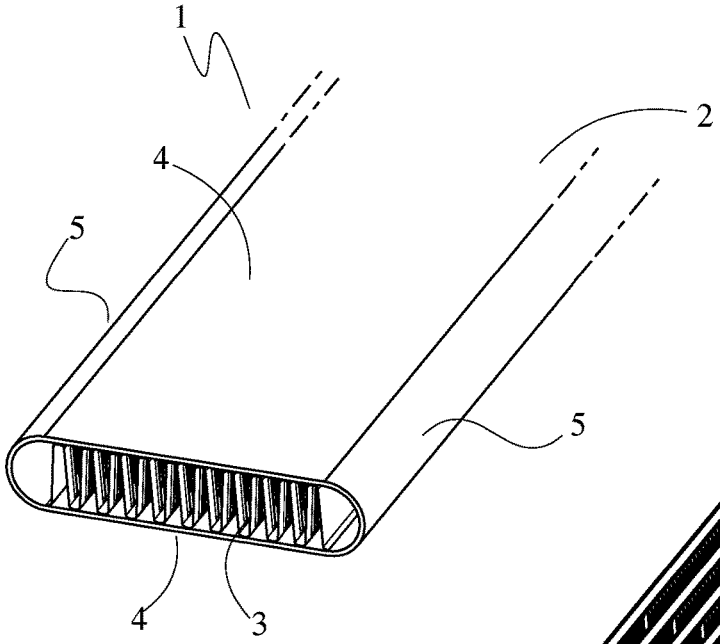
FIG. 1 is a partial perspective view of a tube for a heat exchanger according to an embodiment of the invention.

A tube 1 for a heat exchanger is used to convey a fluid through the heat exchanger so that heat can be transferred to or from the fluid as that fluid passes through an inner volume of the tube. The fluid will generally travel through the tube 1 in an axial direction of the tube 1, from a first open end of the tube 1 to an opposing second open end of the tube 1. The tube inner volume between that first open end and that second open end is bounded by first and second broad, opposing, spaced apart, planar walls 4, and by first and second arcuate end walls 5 that join together the first and second broad planar walls 4 in order to form a tube outer body 2 that encloses the tube inner volume. FIG. 1 depicts a portion of the tube 1 adjacent to one of the first and second open ends.

During operation of the heat exchanger, thermal energy can be transferred from at least some of the outwardly facing surfaces of the tube outer body 2 to a heat sink that is lower in temperature than the fluid flowing through the tube inner volume. The walls of the tube outer body 2 are thereby maintained at a temperature that is between the temperature of the fluid flowing through the tube inner volume and the temperature of the heat sink, so that heat is convectively transferred from the fluid flowing through the tube inner volume to the tube outer body 2 in order to cool the fluid. The heat sink can be, for example, a flow of other fluid that passes over the outer surfaces of the tube outer body 2. Such other fluid can be, for example, cooling air or liquid coolant or a liquid and/or vapor phase refrigerant. In other examples, the heat sink can be a solid element that is disposed against one or more outer surfaces of the tube outer body 2.

It should be understood that, while reference may be made herein to operations of the heat exchanger that result in the cooling of a fluid that passes through the tube inner volume by the transfer of heat from the fluid to a heat sink, the tube 1 can similarly be used to heat such a fluid by the transfer of heat to the fluid from a heat source, the only difference being that the heat source is higher in temperature than the fluid rather than lower in temperature.

Figure 2:
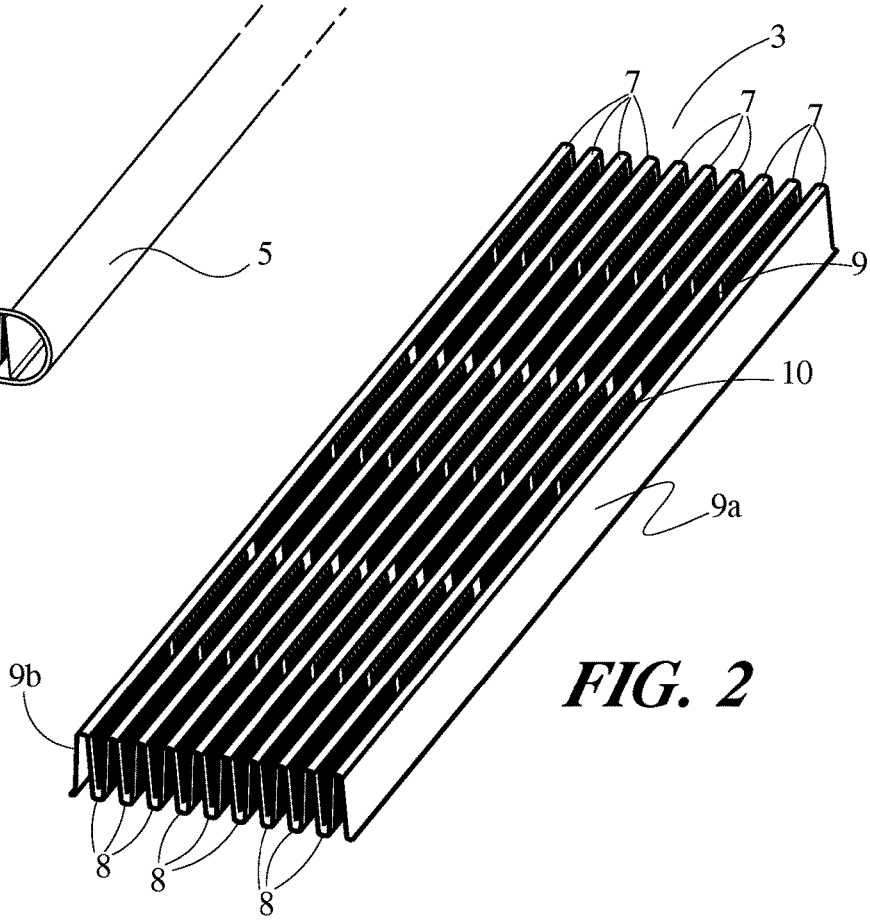
FIG. 2 is a perspective view of a corrugated insert for use in the heat exchanger tube of FIG. 1.

A corrugated insert 3 (depicted in FIG. 2 without the tube outer body 2) is received within the tube inner volume, particularly in order to increase the rate of convective heat transfer between the fluid and the broad planar walls 4. The corrugated insert 3 is formed from a sheet or ribbon of thin metal material, such as, for example, an alloy of aluminum. The material is corrugated to form planar flanks 9, which are alternatingly joined by crests 7 and troughs 8. After the corrugated insert 3 is placed within the tube outer body 2, the crests 7 are disposed against an inwardly facing surface of one of the broad planar walls 4, and the troughs 8 are disposed against an inwardly facing surface of the other one of the broad planar walls 4.

In some especially preferable embodiments, the tube outer body 2 and the corrugated insert 3 are both fabricated from brazeable metal materials, such as brazeable aluminum alloys. The tube outer body 2 can, for example, be formed from brazeable aluminum sheet material by rolling the material to a round shape, thereby bringing the opposing edges of the sheet material together. Those opposing edges can be joined together, by welding for example, and the resultant round tube can be flattened to form the two broad, opposing, spaced apart, planar walls 4 and the two arcuate end walls 5.

The surface of the sheet material that is to become the inwardly facing surface of the tube outer body 2 can be provided with a clad layer of braze alloy, which can then be used to join the crests 7 and troughs 8 of the corrugated insert 3 to the broad planar walls 4 in a brazing operation. By creating such braze joints, the transfer of heat between the corrugated insert 3 and the broad planar walls 4 can be greatly enhanced, thereby improving the heat transfer capability of the heat exchanger tube 1.

In some cases it may be preferable to form the tube outer body 2 with outer walls 4 that are originally non-planar in shape. For example, the walls 4 can be first formed with a slightly convex shape. This can allow for easier insertion of the corrugated insert 3 into the tube inner volume. After the corrugated insert 3 has been placed into the tube inner volume, the walls 4 of the tube outer body 2 can be fully flattened in order to bring them into full contact with the crests 7 and the troughs 8. This can, for example, be done during the assembly of the heat exchanger tube 1 into the eventual heat exchanger. The heat exchanger can subsequently be brazed, at which point the braze connections between the crests and troughs and the broad planar walls can also be created.

Figure 4:
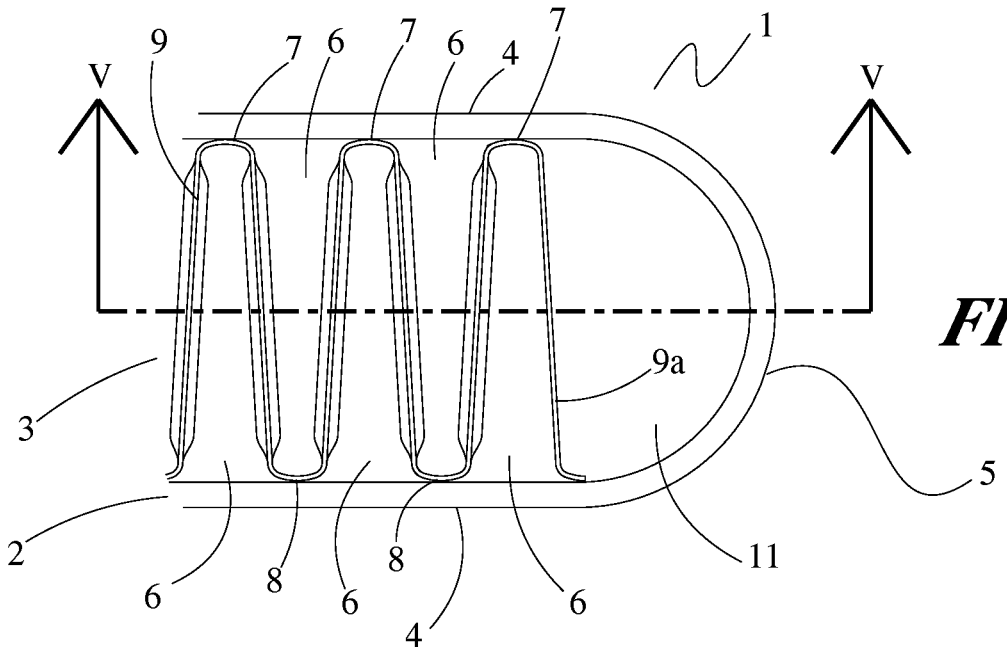
FIG. 4 is a detail view of the portion IV-IV of FIG. 3.
Figure 5:
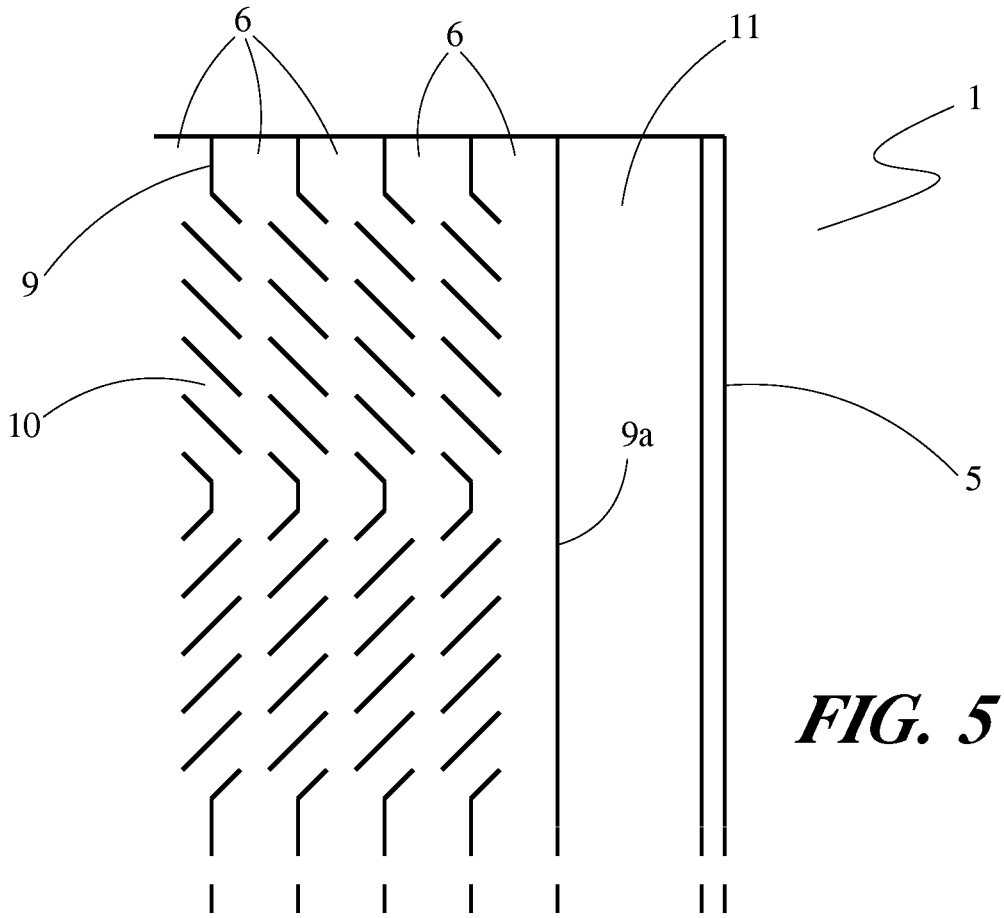
FIG. 5 is a cross-sectional view along the lines V-V of FIG. 4.

As shown in particular detail in FIGS. 4 and 5, the corrugated insert 3 separates the tube inner volume into a series of flow channels 6 that extend between the first and second open ends of the tube 1. Each one of the flow channels 6 is defined by a pair of the planar flanks 9, a crest 7 or trough 8, and one of the broad planar walls 4, particularly that one of the broad planar walls 4 that is opposite of the crest 7 or trough 8. The rate of convective heat transfer as the fluid passes through the flow channels 6 is enhanced by the relatively small hydraulic diameter of the flow channels 6, which results from a relatively tight center-to-center spacing of adjacent flanks 9 of the corrugated insert 3.

As further shown in FIGS. 4 and 5, the inner volume of the tube 1 also includes a first bypass channel 11 adjacent to one of the arcuate end walls 5, and a s second bypass channel 12 adjacent to the other one of the arcuate end walls 5. Such bypass channels 11, 12 generally result from the inability to extend the corrugated insert 3 into the areas of the tube 1 beyond the ends of the broad planar walls 4. It can be especially preferable to minimize that percentage of the total fluid flow through the tube 1 that passes through the bypasses 11, 12. As one exemplary reason, the broad planar walls 4 are often the preferred heat transfer path into the heat sink, such as when fins for a heat sinking fluid are bonded to the outer surfaces of the walls 4 or when a solid heat sink is disposed against the walls 4. As another exemplary reason, the ratio of the center-to-center spacing of adjacent flanks 9 to the distance between the parallel walls 4 is often such that the hydraulic diameter of the bypass channels 11, 12 is substantially larger than the hydraulic diameter of a flow channel 6, so that the rate of convective heat transfer for fluid passing through the bypass channels 11, 12 is substantially lower than the rate of convective heat transfer for fluid passing through the flow channels 6.

The rate of convective heat transfer within the flow channels 6 can be further enhanced by flow turbulation features that are optionally provided on at least some of the planar flanks 9. The flow turbulation features can, by way of example, be provided by openings 10 that are formed into the planar flanks 9 at intervals along the length of the flow channels 6. The openings 10 are formed, in the exemplary embodiment of FIGS. 1-5, as louvered openings. The louvered openings (or louvers) 10 are formed by piercing the material of the corrugated insert 3 at intervals along the flank 9, and then rotationally displacing the strip of material between adjacent piercings out of the plane of the flank 9 to form openings 10 that are angled with respect to the tube-axial direction, the resulting louvered openings 10 thus forming angularly oriented communicating passages between adjacent ones of the flow passages 6. As shown in FIG. 5, the louvers 10 can be arranged in banks of multiple louvers 10, with the louvers in each bank being oriented in the same direction and with the banks themselves having alternating directions of orientation along the tube-axial direction. This causes the fluid to repeatedly pass from one flow channel 6 to an adjacent flow channel 6 as it flows from one of the open ends of the tube 1 to the other open end of the tube 1. As a result, the build-up of a fluid boundary layer along the planar flank 9 is disrupted, thereby increasing turbulence of the flow and, consequently, enhancing the convective heat transfer rate.

Figure 3:
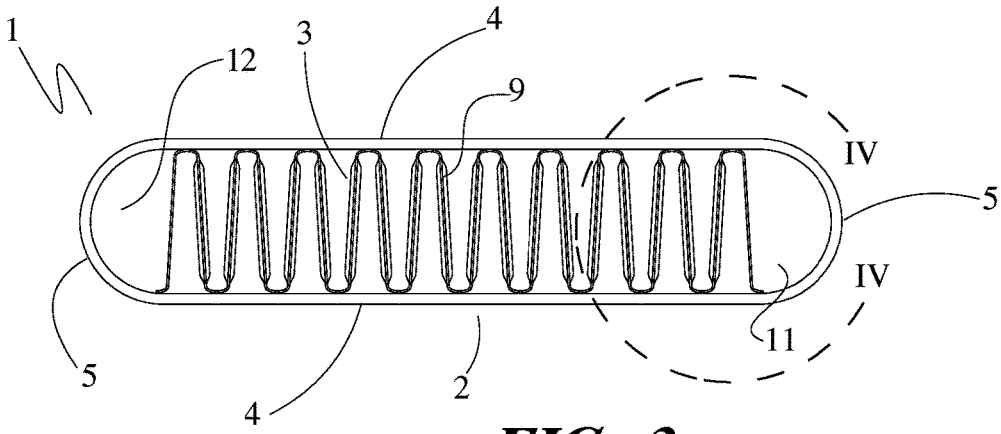
FIG. 3 is an end view of the heat exchanger tube of FIG. 1.

In order to prevent the passage of fluid from an end one of the flow channels 6 into the adjacent bypass channel 11 or 12, it can be especially advantageous to have the end ones of the planar flanks (indicated as **9*a* and 9*b* in FIG. 3) be absent of the openings 10. As seen in FIG. 4, the bypass channel 11 is bounded by an arcuate end wall 5, at least one of the broad planar walls 4, and the end one 9*a* of the planar flanks 9. By having the planar flank 9*a* be absent of any openings 10, the bypass channel 11 can be fluidly isolated from the adjacent flow channel 6 along the length of the tube 1. This provides certain advantages in that, as described previously, the bypass channels are less capable of transferring heat to or from the fluid than the flow channels 6 are, and it is therefore desirable to minimize the passage of flow into the bypass channels. As can be seen in FIG. 3, the bypass channel 12 (which is bounded by at least one of the broad planar walls 4, the other arcuate end wall 5, and the end one 9*b* of the planar flanks 9) is similarly isolated from the adjacent flow channel 6 by having the planar flank 9*b* be absent of any openings 10**.

Figure 6:
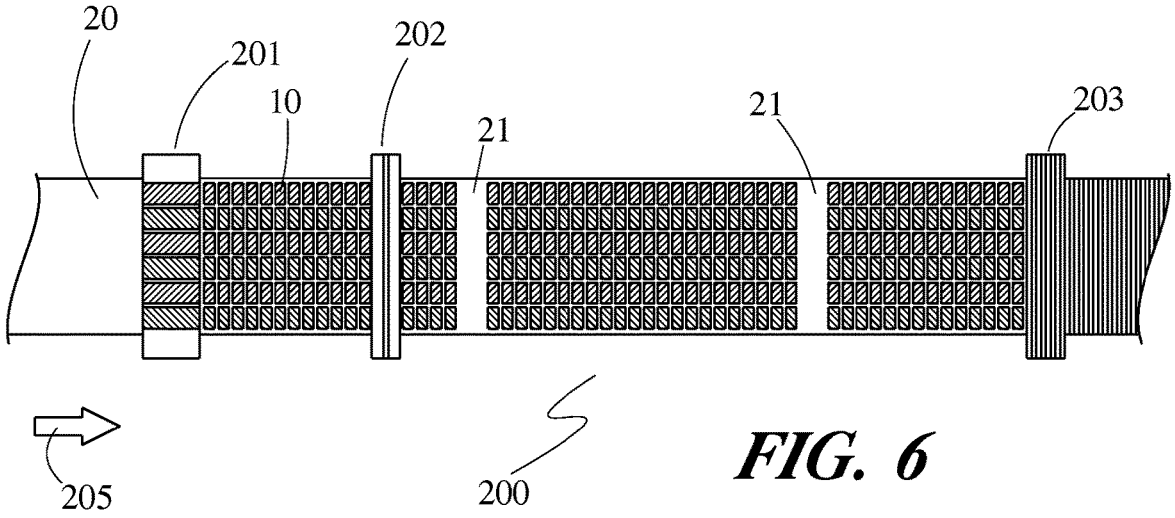
FIGS. 6 and 7 are diagrammatic representations of selected steps of a method of making a tube for a heat exchanger, according to some embodiments of the invention.
Figure 7:
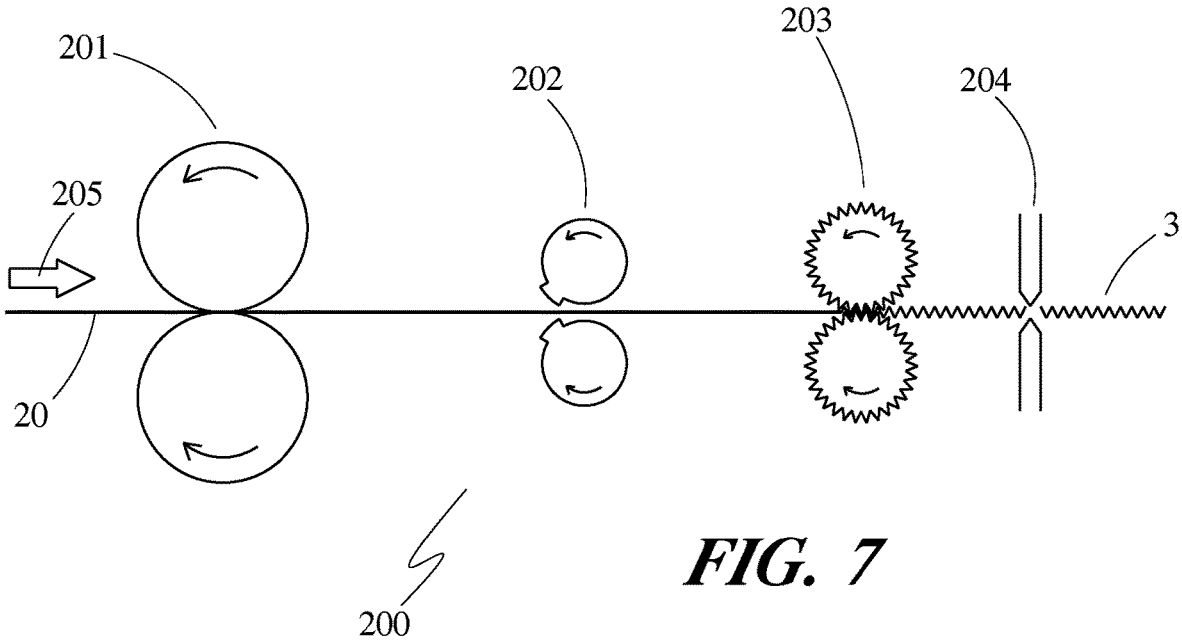

FIGS. 6 and 7 depict a method by which the corrugated insert 3 as shown in FIGS. 1-5 can be manufactured. It should be understood by those skilled in the art that the method depicted has been simplified for ease of understanding, and that certain operations that are known and well-understood by those of skill in the art have been excluded from the figures but may still be present.

As shown in FIGS. 6 and 7, the corrugated insert 3 having planar flanks joined by alternating crests and troughs can be manufactured using a fin machine 200 that includes several sequentially arranged stations 201, 202, 203, and 204, among others. A continuous ribbon 20 of material, preferably a thin, brazeable metal material, is directed through the sequentially arranged stations in a feed direction 205. Banks of louvers 10 are formed into the ribbon 20 in a station 201 by a pair of fin rolls that rotate in opposing directions, the ribbon 20 passing between the rolls. The rolls of the station 201 can be in the form of stacked circular disks, with some of the disks being cutting disks that pierce and displace the material of the ribbon 20 to form the louvers 10, and some other of the disks being spaces disks arranged between the cutting disks to space apart the louvers 10 apart.

Downstream from the station 201 along the feed direction 205 is a station 202. A pair of rotating embossing rolls in the station 202 rotate in opposing directions to close selected ones of the louvers 10 by re-forming those selected ones of the louvers 10 to lie flush within the plane of the ribbon 20. As a result of the operation in the station 202, the ribbon 20 downstream of the station 202 has un-louvered regions 21 extending along the width of the ribbon 20 (i.e. perpendicular to the feed direction 205), with those un-louvered regions 21 being spaced at regularly repeating internals along the feed direction 205.

Downstream from the station 202 along the feed direction 205 is a station 203. A pair of folding rolls in the station 203 rotate in opposing directions to corrugate the ribbon 20, forming the planar flanks 10 joined by alternating crests 7 and troughs 8. The fin machine 200 is preferably set so that the station 203 forms the crests 7 and troughs 8 at locations that are between successive louvers 10 in the feed direction 205, thereby causing the louvers 10 to be located on the planar flanks 9 of the ribbon 20.

Downstream from the station 203 along the feed direction 205 is a cut-off station 205, wherein corrugated inserts 3 having a pre-defined number of corrugations are separated from the continuous ribbon 20. The fin machine 200 is preferably set so that the separation of the corrugated inserts 3 from the ribbon 20 occurs at corrugations that are formed at the center of each of the un-louvered regions 21, so that each of the corrugated inserts 2 is provided with end flanks 9*a*, 9*b* that are absent of the louvers 10, the louvers of those flanks having been closed in the station 202.

Figure 8:
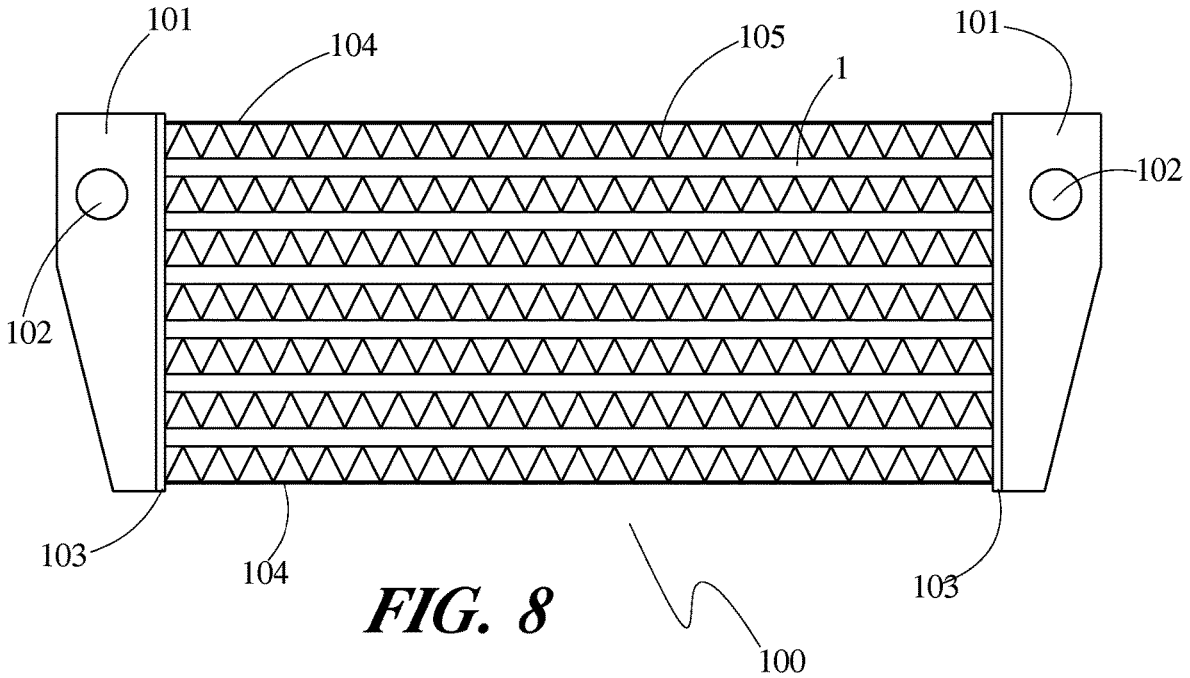
FIG. 8 is a frontal view of a heat exchanger employing heat exchanger tubes according to some embodiments of the invention.
Figure 9:
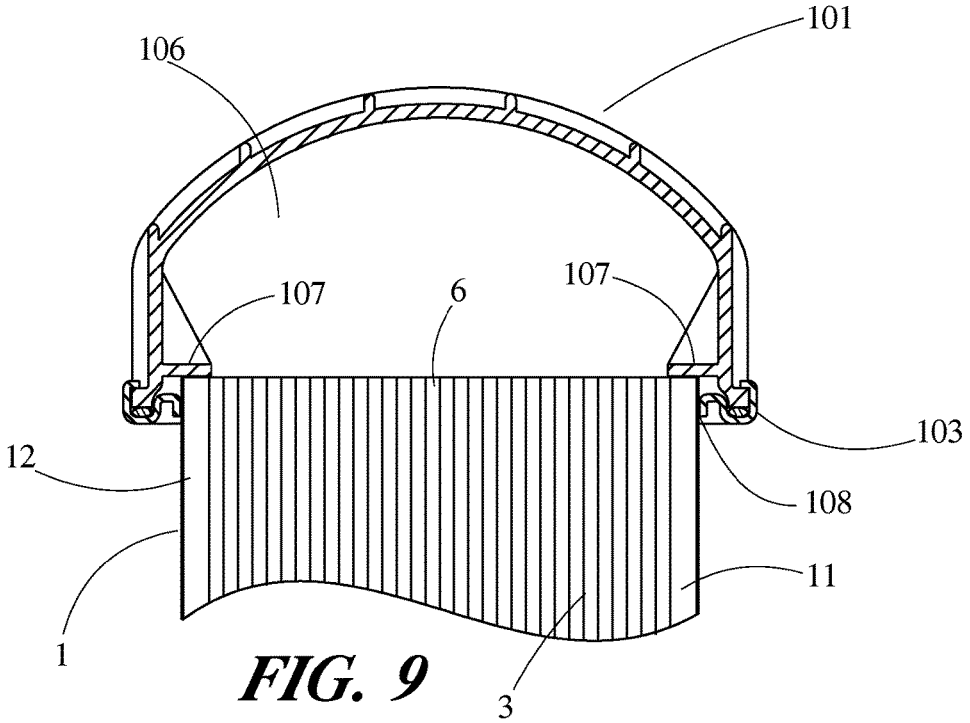
FIG. 9 is a partial, cross-sectional view of the heat exchanger of FIG. 8, taken through a centerline of one of the heat exchange tubes.

FIG. 8 depicts a heat exchanger 100 that is constructed using several of the heat exchange tubes 1 of FIGS. 1-5. The several tubes 1 are arranged in parallel and spaced apart from one another, and adjacent ones of the tubes 1 are joined together by fins 105 that are arranged in the gaps between the tubes 1 to define air flow passages. Ends of the tubes 1 are received in header plates 103, the hear plates 103 having openings 108 formed therein to receive the tube ends. A fluid tank 101 is sealingly connected to each of the header plates 103 (by, for example, a crimp joint, as shown in FIG. 9).

Prior to assembly of the tanks 101, the core of the heat exchanger 100 (including the tubes 1, the air fins 105, the header plates 103, and optionally a pair of side plates 104) can be joined together as a monolithic structure by a brazing operation. This brazing operation can serve to create joints between the corrugated insert 3 and the tube outer body 2 of each tube 1, as well as between the broad planar walls 4 and the air fins 105, and the ends of the tubes 1 and the header plates 103. Alternatively, multiple successive brazing operations can be used to form the joints.

Once the tanks 101 are joined to the header plates 103, they form a fluid manifold 106 at each end of the heat exchanger 100. Fluid flow can be directed into or out of each manifold 106 through ports 102 provided in the tanks 101, so that the heat exchanger 101 can be part of a flow circuit for the fluid. As the fluid is directed through the heat exchanger 100 through the tubes 1, the desired heat transfer between the fluid and, for example, a cooling air flow that passes through the air flow passages is achieved.

In order to maximize the heat transfer efficiency of the heat exchanger 100, it can be particularly beneficial to minimize the percentage of fluid flow through the bypass channels 11 and 12 of each tube 1, for the reasons provided earlier. This can be achieved by providing flow blocks at one or both ends of the tubes 1 in the region of the bypass channels 11, 12. As depicted in FIG. 9, the flow blocks can take the form of a wall 107 that extends into the manifold 106 from the tank 101 can covers the inlet or outlet end of the bypass channel, thereby reducing or even preventing the percentage of the flow that passes through the bypass channel. Since the bypass channels 11 and 12 can be fluidly isolated from the adjacent flow channels 6 by having the end ones 9*a*, 9*b* of the planar flanks 9 be absent of the openings 10, the fluid flow can be entirely or mostly directed through the flow channels 6, thereby maximizing the heat exchanger performance.

Figure 10:
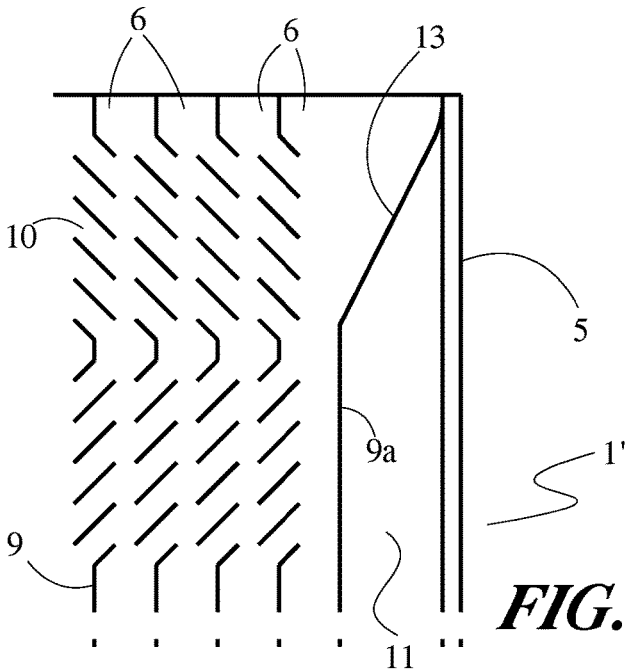
FIG. 10 is an alternative version of the heat exchanger tube of FIG. 5.

FIG. 10 depicts an alternative version 1' of the heat exchanger tube 1 as depicted in FIG. 5. The tube 1' is similar in all respects to the earlier described tube 1, except that a flow block to minimize or prevent the passage of fluid flow through the bypass channel 11 is incorporated within the tube 1' itself by a terminal portion 13 of the planar flank 9*a*. As used herein, the terminal portion of the planar flank should be understood to mean a portion of the flank that extends from one of the open ends of the tube into the tube inner volume by a short distance, as compared to the overall length of the tube.

As indicated in FIG. 10, the terminal portion 13 of the flank 9*a* is deflected against the arcuate end wall 5 that bounds the bypass channel 11. When arranged at the inlet end of the tube 1', this results in the fluid flow that would otherwise pass into the bypass channel impacting against the terminal portion 13 and being instead directed by that terminal portion 13 into the adjacent one of the flow channels 6. The excess flow within that flow channel 6 can subsequently be redistributed among the adjacent flow channels 6 by way of the openings 10 that are provided in the planar flanks 9 separating those flow channels 6. Entry into the bypass channel 11 downstream of the terminal portion 13 is prevented by the absence of such openings 10 in the planar flank 9*a*.

The flow block can alternatively be provided at the opposing end of the tube 1', i.e. at the outlet end of the tube. Flow into the bypass channel 11 would, in this case, be prevented by the inability of the fluid to leave the bypass channel 11 at the end having the deflected terminal portion 13. It should be understood that the terminal portions 13 can also be provided at both ends of the tube 1', in order to make the tube construction symmetrical for manufacturing. In addition, while the bypass channel 11 is depicted for illustration, it should be understood that the terminal portion or portions of the other end planar flank 9*b* can be deflected in a similar way.

Flow blocks created by the deflected terminal portions 13 can be particularly effective in blocking the flow of fluid through the bypass channels 11, 12 when the terminal portions 13 are deflected prior to the creation of braze joints between the insert 3 and the tube outer body 2. This allows for the deflected terminal portion 13 to also be bonded to the arcuate end wall 5 by brazing, thereby creating a more effective fluid seal, as well as ensuring that the terminal portion 13 remains in its deflected state.

Figure 11A:
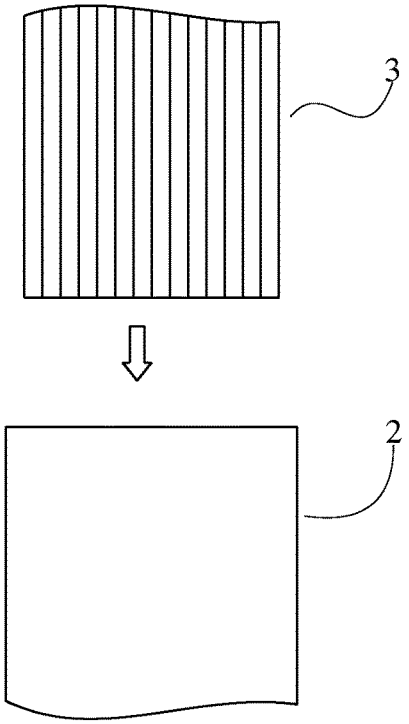
FIGS. 11A, 11B, and 11C are diagrammatic representations of other selected steps of a method of making a tube for a heat exchanger, according to some embodiments of the invention.
Figure 11B:
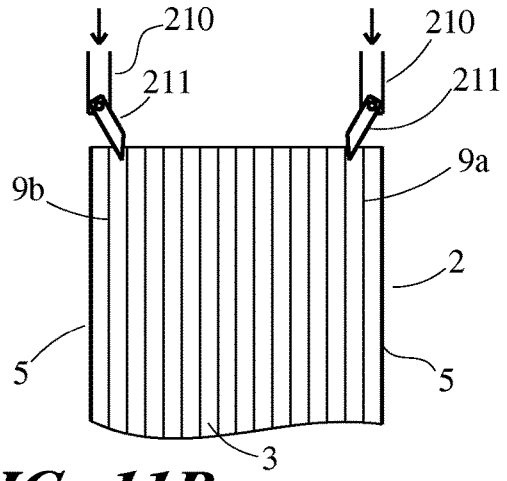
Figure 11C:
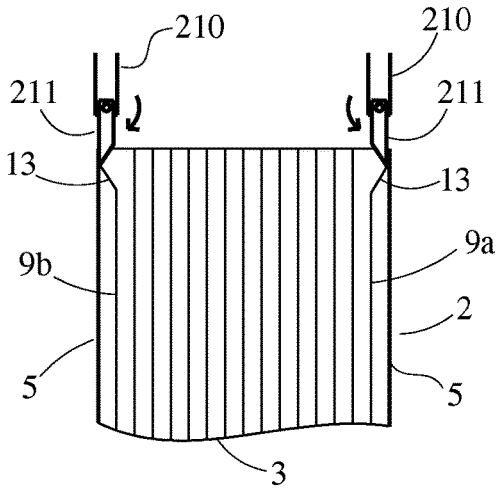

FIGS. 11A-11C depict several steps of a method by which the heat exchanger tube 1' can be manufactured. After the corrugated insert 3 is created (for example, as previously described with reference to FIGS. 6 and 7), it is inserted into the tube outer body 2, as depicted in FIG. 11A. After the insert 3 is arranged within the tube outer body 2, the terminal portions 13 of the two end planar flanks 9*a*, 9*b* are deformed so as to be in contact with the arcuate end walls 5 in a forming operation, depicted in FIGS. 11B and 11C.

A tool having a translating part 210 and a rotating part 211 is used to deform the terminal portion 13 in this operation. The translating part 210 travels towards the open end of the tube, carrying with it the rotating part 211, which is pivotably mounted at the advancing end of the translating part 210. The translating part 210 stops when an end of the rotating part 211 is positioned within a flow channel 6 that is adjacent to one of the end flanks 9*a*, 9*b*. The rotating part 211 then pivots about the pivot point so that the end of the rotating part 211 engages the end flank 9*a* or 9*b*, and deforms the terminal portion 13 of that end flank so that is abuts the adjacent arcuate end wall 5. The end of the rotating part can be shaped to have a profile that matches the arcuate end wall 5 profile, so that the terminal portion 13 fully engages the end perimeter of the arcuate end wall 5, thereby closing off the bypass channel 11 or 12 to flow.

As depicted in FIGS. 11B and 11C, the terminal portions 13 of both end flanks 9*a* and 9*b* can simultaneously be deformed in a single operation using a pair of the described tools. Alternatively, a single tool can be used and the two end flanks can be deformed sequentially using that tool. In addition, it should be understood that, while the figures depict a single end of the tube for ease of description, the same operations can be performed, either simultaneously or sequentially, at the opposing end of the tube.

The deformation of the end portions 13 as described preferably occurs prior to brazing of the tube 1', so that each deformed portion 13 can be joined by braze joints to the adjacent arcuate end wall 5 in order to form a more permanent and leak-free seal. Alternatively, the same tool and method can be performed after brazing of the tubes 1' to header plates but before the assembly of tanks to the header plates.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

What is claimed is:

1. A tube for a heat exchanger, comprising:

a tube outer body including first and second broad, opposing, spaced apart, planar walls joined by first and second arcuate end walls, the tube outer body enclosing a tube inner volume bounded by the first and second broad planar walls and the first and second arcuate end walls;

a corrugated insert received within the tube inner volume, the corrugated insert including planar flanks joined by crests and troughs, the crests and troughs being bonded to the first and second broad planar walls, respectively;

a plurality of flow channels extending through the tube inner volume from an inlet end of the tube to an outlet end of the tube, each one of the plurality of flow channels being bounded by one of the first and second broad planar walls of the tube outer body, a crest or a trough of the corrugated insert, and two adjacent ones of the planar flanks that are joined by that crest or trough, wherein adjacent ones of the plurality of flow channels are in fluid communication with one another between the inlet and outlet ends of the tube by way of a plurality of openings in the planar flanks;

a first bypass channel bounded by at least one of the first and second broad planar walls, the first arcuate end wall, and a first planar flank of the planar flanks, the first planar flank being that one of the planar flanks arranged nearest to the first arcuate end wall; and a second bypass channel bounded by at least one of the first and second broad planar walls, the second arcuate end wall, and a second planar flank, the second planar flank being that one of the planar flanks arranged nearest to the second arcuate end wall;

wherein the first and second planar flanks are absent of any openings, so that flow between any one the plurality of flow channels and the first and second bypass channels is prevented, and wherein the tube includes a first flow block, the first flow block being formed by a portion of the first planar flank and prevents fluid flow through the first bypass channel by extending to contact the first arcuate end wall to close the first bypass channel.

2. The tube of claim 1, wherein the first flow block is formed from a terminal portion the first planar flank.

3. The tube of claim 2, wherein the terminal portion of the first planar flank is bonded to the first arcuate end wall by a braze joint.

4. The tube of claim 1, wherein the tube includes a second flow block, the second flow block being formed by a portion of the second planar flank and prevents fluid flow through the second bypass channel by extending to contact the second arcuate end wall to close the second bypass channel.

5. The tube of claim 4, wherein the first flow block and the second flow block are both arranged at the inlet end of the tube.

6. The tube of claim 4, wherein the second flow block is formed by a terminal portion of the second planar flank.

7. The tube of claim 6, wherein the terminal portion of second planar flank is bonded to the second arcuate end wall by a brazejoint.

8. The tube of claim 1, wherein the plurality of openings in the planar flanks other than the first and second planar flanks comprise louvered openings.

9. A method of making a tube for a heat exchanger according to claim 1, the method comprising:

forming the corrugated insert;

inserting the corrugated insert into the tube outer body, where the tube outer body has been flattened; and deforming a terminal portion of at least one of the first and second planar flanks to be in contact with a respective one of the first and second arcuate end walls.

10. The method of claim 9, further comprising forming braze joints between the crests and troughs of the corrugated insert and the first and second broad, opposing, spaced apart, planar walls, and between the terminal portion and that one of the first and second arcuate end walls.

11. The method of claim 9, wherein the step of forming a corrugated insert comprises:

forming sets of louvers into a continuous ribbon of material at select intervals along a length direction of the continuous ribbon by piercing and displacing the material;

closing selected ones of the sets of louvers by re-displacing the material;

folding the continuous ribbon to form corrugations such that the crests and troughs are arranged between adjacent sets of louvers; and separating the corrugated insert from the continuous ribbon at a location adjacent to one of the closed sets of louvers.

12. The method of claim 11, wherein the selected ones of the sets of louvers that are closed includes two adjacent sets of the louvers and wherein the corrugated insert is separated from the continuous ribbon at a location between said two adjacent sets of the louvers.

* * * * *